United States Patent [19]

Perry

[11] Patent Number: 4,582,261

[45] Date of Patent: Apr. 15, 1986

[54] PULPER

[75] Inventor: Kenneth E. Perry, Wellesley, Mass.

[73] Assignee: Adamation, Newton, Mass.

[21] Appl. No.: 612,055

[22] Filed: May 18, 1984

[51] Int. Cl.[4] ..... B02C 18/40; B02C 23/36

[52] U.S. Cl. ..... 241/21; 241/24; 241/46.17; 241/79

[58] Field of Search ..... 241/21, 46.17, 46.11, 241/46.02, 74, 60, 79, 41, 48, 24

[56] References Cited

U.S. PATENT DOCUMENTS

| | | | |
|---|---|---|---|
| 3,188,942 | 6/1965 | Wandel | 241/46.17 X |
| 3,547,357 | 12/1970 | Johnson | 241/46.17 X |
| 3,713,594 | 1/1973 | Blakely et al. | 241/46.17 X |
| 3,774,853 | 11/1973 | Seifert | 241/46.17 X |
| 3,780,956 | 12/1973 | Miller, Jr. et al. | 241/46.17 X |
| 3,784,116 | 1/1974 | Buckman et al. | 241/46.17 |
| 3,877,648 | 4/1975 | Vokes | 241/46.17 X |
| 3,897,013 | 7/1975 | Love | 241/46.17 X |
| 3,990,643 | 11/1976 | Neitzel | 241/46.17 X |
| 4,167,249 | 9/1979 | Kohrs | 241/46.17 |

*Primary Examiner*—Mark Rosenbaum

*Attorney, Agent, or Firm*—Thompson, Birch, Gauthier & Samuels

[57] ABSTRACT

A pulper to convert bulky, solid wastes from food service establishments into a uniform, moist pulp. The material is pulverized in a first section and transferred as a slurry to a second section where the slurry is dewatered by an auger. To prevent clogging of the auger, a portion of the liquor extracted from the pulp is introduced as a jet stream into the upstream end of the auger to create turbulence. Additionally, a reverse flow of water through a drain chamber in excess of the amount of water required for make-up in the system is employed to prevent clogging of the screen covering the drain.

16 Claims, 4 Drawing Figures

PULPER

BACKGROUND AND BRIEF SUMMARY OF THE INVENTION

This invention relates to a pulper which converts bulky, solid wastes to a uniform moist pulp.

In restaurants, food service establisments, cafeterias and the like the refuse comprising scrap food, napkins, bags, boxes, milk cartons, etc., are typically deposited in plastic bags. When the bags are filled the tops are tied, the bags stored and ultimately removed. Waste in this form takes considerable storage space. Also, when it is trucked away, most of the volume carried by the trucks is air.

To reduce the volume, many establishments, particularly food service establishments, use a device known as a pulper which reduces the volume of waste approximately 75%. Briefly, all refuse is pulverized to form a slurry and then the pulp is extracted from the slurry. One such pulper known in the food equipment industry is exemplified in U.S. Pat. No. 3,188,942.

These pulpers generally comprise a pulverizing section to disintegrate the materials forming a slurry and a separating section to remove the solids from the slurry. The separating section includes an auger received in a cylindrical screen. The auger carries the slurry and de-waters the same to form a moist pulp and a liquor.

In some pulpers currently used, the auger has a tendency to jam when solids build up occurs between the crest of the auger and the surrounding screen. When this occurs the pulper must be shut down and the obstruction removed, a process requiring the dismantling of the unit.

The use of large quantities of make up water to keep the carrier liquid 'fresh' requires essentially that a volume of liquid proportional to the make up water continuously discharge down the drain at the same time maintaining a constant volume of carrier water in the system. Present pulpers can only add that amount of water removed with the dewatered pulp if the carrier volume in the system is to remain constant.

The present invention is directed to an apparatus and method which broadly is an improvement of the prior art pulping apparatus and which minimizes to the point of elimination the jamming of the auger and prevents clogging of the drain when desirable large quantities of make up water is used. Broadly, the invention in one embodiment, recycles a portion of the liquor extracted from the pulp as a jet stream into the upstream end of the auger to create turbulence thereby preventing increased solids contents from forming. In a preferred embodiment, a restricted flow path is formed to limit the size of the particulate material flowing to the base of the auger.

In the preferred embodiment, a second by-pass system, considerably larger in volume than the make-up water added, is introduced in the drain chamber and directed against the screen. The more or less exact quantity of the make-up water goes down the drain chamber stand pipe and the balance flows back into the pulper chamber through the screen holes kept clean from outside debris by the by-pass stream. Thus, the equilibrium quantity of the carrier liquid is maintained even though excess make-up water is continuously added to keep the carrier liquid from 'thickening' from garbage during constant use.

DESCRIPTION OF THE EMBODIMENT

Figure 1:
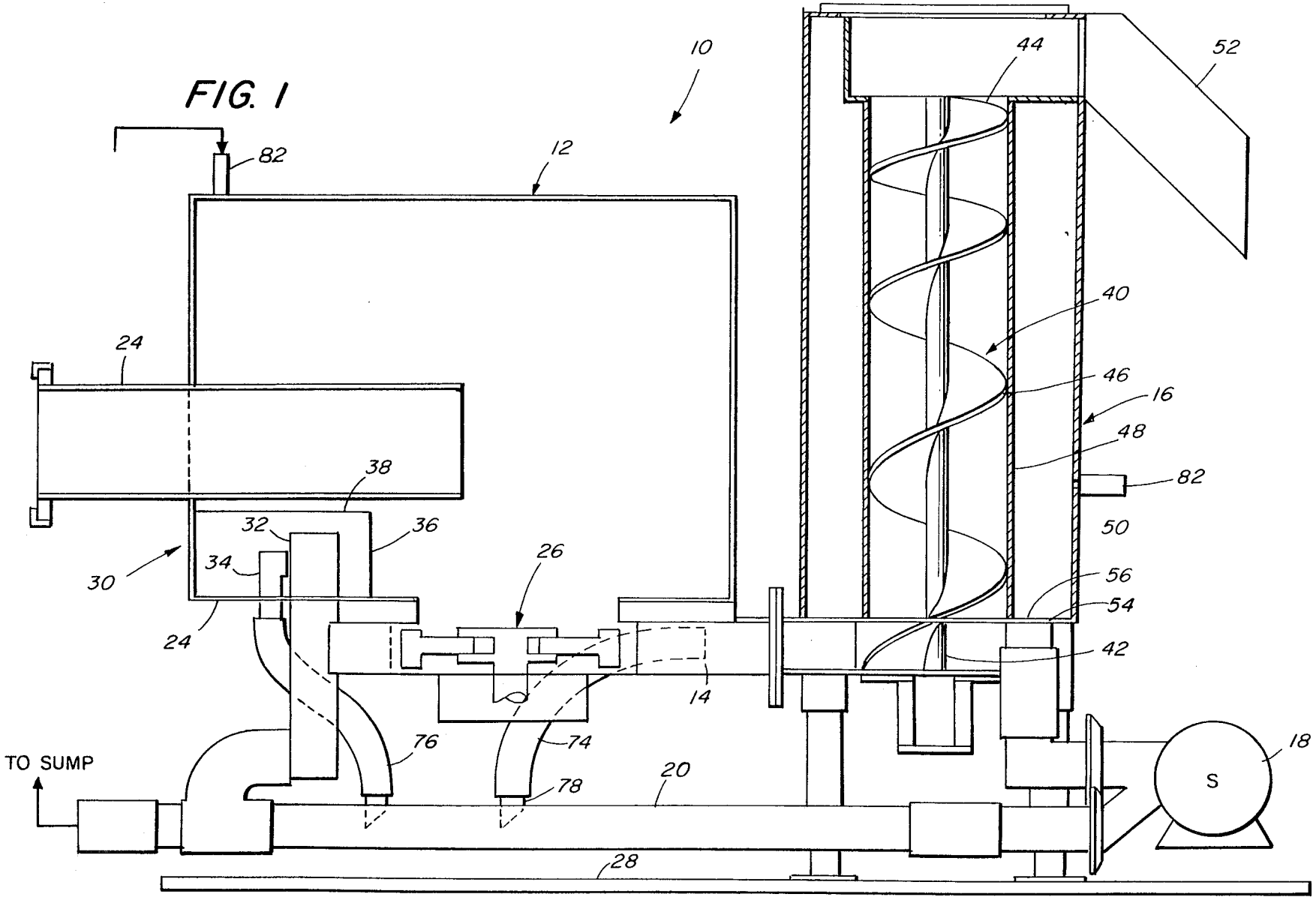
FIG. 1 is a side sectional view of an apparatus embodying the invention.
Figure 2:
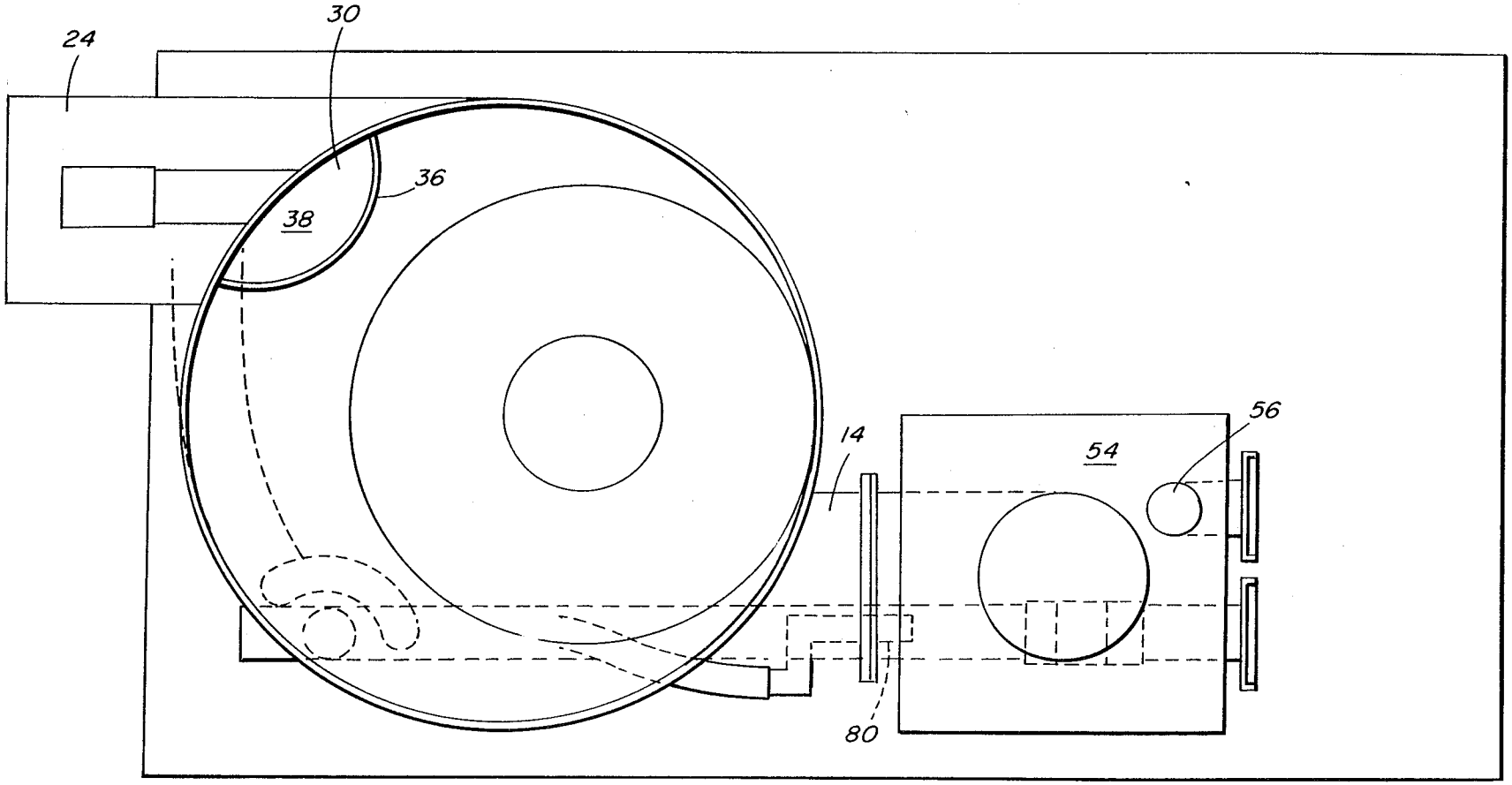
FIG. 2 is a plan view of the apparatus of FIG. 1; the inlet not shown to enhance clarity.
Figure 4:
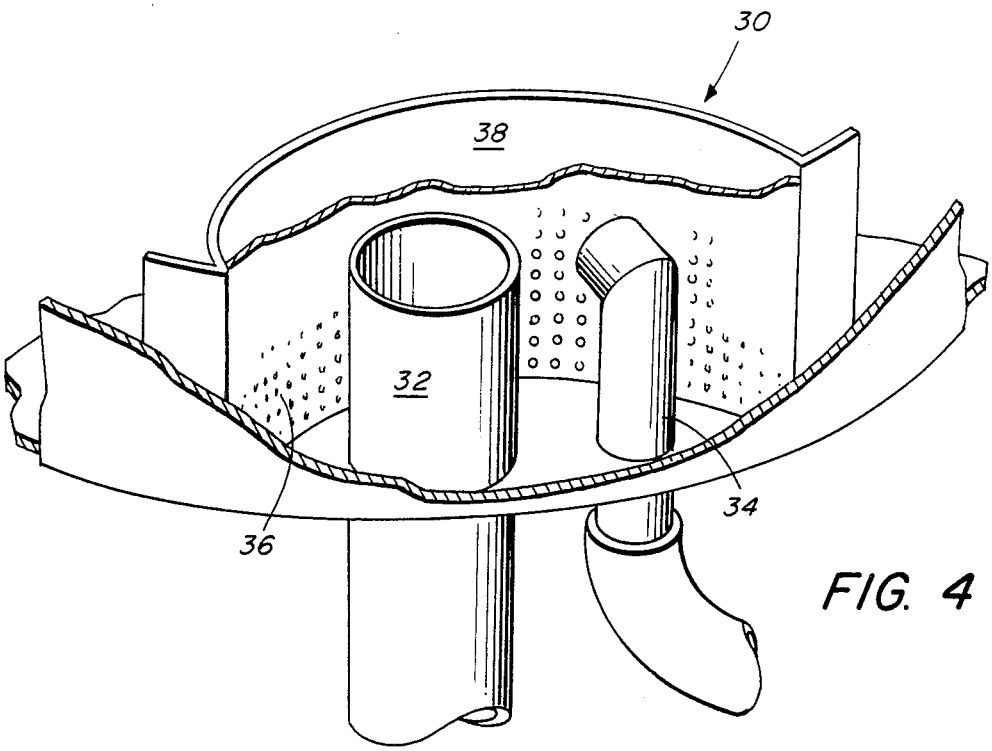
FIG. 4 is a perspective fragmentary view of the drain chamber of FIG. 1.

Referring to FIG. 1, the invention shown generally at 10 comprises a first housing 12 having an inlet 24, a pulping device 26, such as commonly used in the art, which is rotatably secured to the base plate 28. A drain chamber 30, shown in more detail in FIG. 4, comprises a drain or stand pipe 32, a by pass line 34 both shielded by a screen wall 36 and a cover 38.

A conduit 14 transfers the pulverized material as a slurry from the first housing 12 to a second housing 16.

An auger 40 is rotatably secured in the housing 16 and includes an upstream end 42, a downstream end 44 and crests 46. The auger is received in a sleeve-like screen 48 and the sleeve 48 defines with the inner wall of the second housing a chamber 50. At the upper portion of the housing in communication with the downstream end of the auger is an outlet chute 52 for the discharge of the moist pulp.

The floor 54 of the housing 16 includes an orifice 56 for the discharge of liquor from the chamber 50.

Figure 3:
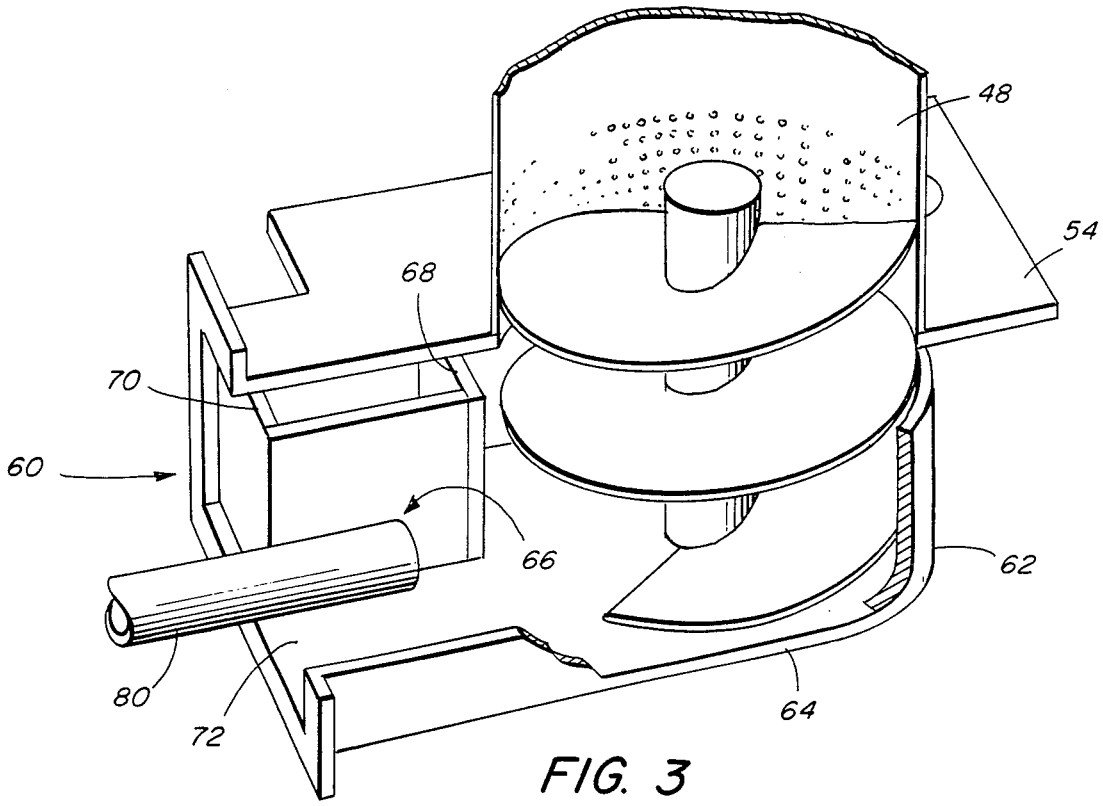
FIG. 3 is a perspective fragmentary view of the inlet of FIG. 1.

Formed below the floor 54 of the housing 16 is an inlet assembly 60, see FIG. 3, which comprises a wall 62, a floor 64 and a baffle assembly 66 comprised of two L-shaped members 68 and 70 which form a restricted flow path 72.

A pump 18 recycles the liquor from the chamber 50 back to and through a garbage trough and/or sump (not shown) through a recycle conduit 20. The sump communicates with the first housing 12.

The recycle conduit 20 includes a jet by-pass 74 and a drain chamber by-pass 76 both of which are shown in FIG. 1. The jet by-pass 74 comprises a duct 78 secured to the conduit 20 to intercept the recycled liquor and a duct 80 within the conduit 14. The downstream end of the duct 80 enters the inlet assembly 60. The restricted flow path 72 is between the discharge end of the duct 80 and the upstream end of the auger 42. The flow path 72 prevents large pieces of waste material from flowing to the auger 40. The duct 80 in combination with the flow path 72 directs the jet stream of recycled liquor into the base of the auger concurrently with the direction of rotation of the auger. If desired the jet stream may be introduced countercurrently with reference to the direction of rotation of the auger.

The drain chamber by-pass enters the drain chamber 30 adjacent the stand pipe 32 via duct 34. The flow of the recycled liquor from the line 76 results in flow through the screen 36 into housing 12 and thus prevents the sucking in of water and consequent build up of debris on the outer surface of the screen caused by carrier liquid in tank 12 flowing down stand pipe 32. A water make-up line 82 discharges into the first housing as shown in FIG. 1.

In operation of the invention the housing 12 is filled with approximately 4 inches of water and the pulverizer 26, the auger 36 and the pump 18 are actuated. Water make-up is introduced into housing 16. Refuse is dumped into the housing 12 through the inlet 24. The pulper 26 disintegrates the materials introduced forming a slurry. The slurry is drawn through conduit 14 and into the inlet assembly 60 of the housing 16. The slurry flows through the restricted flow path 72 into the upstream end 42 of the auger 40. The duct 80 jets recycled liquor into the upstream end of the auger to create turbulence and prevent accumulation of solids. The auger as with prior art devices compresses the slurry as it moves upwardly with the liquor flowing through the screen 48 into the chamber 50. The moist pulp is discharged at the outlet 52 and the liquor recirculated. The by-pass 76 introduces recycled liquor into the drain chamber 30 to maintain the screen free of debris. The make-up water is added in excess of what is removed with the moist pulp to ensure a positive overflow.

In a working embodiment of the invention which has been found satisfactory the clearance between the crests of the auger and the screen is fifty thousandths of an inch. The baffle plates form a restricted flow path two inches square and the duct 80 is one inch tubing. The by-pass lines 74 and 76 as shown are cut on a 45° angle. Any dimension including a 90° cut may be used depending upon flow rates and other dimensions of the pulper. The flow rate of water through the recycle conduit 20 is approximately 180 gallons per minute.

When operating, approximately 180 gal/min liquid enters the second housing. Approximately 1 gal/min is discharged with the moist pulp. In this invention the made up water exceeds that which is necessary to make up system losses, such as the approximately 1 gal/min lost with the moist pulp. In the working embodiment approximately 8 gal/min make up is used, which in fact is soapy wash water overflow and used rince water taken from a dishwashing system. This provides a positive flow of 'fresh clean' water which is then continuously introduced into the system at a rate of approximately 8 gal/min. Approximately 1 gal/min is discharged with the moist pulp and 7 gal/min is discharged through the standpipe 32. This excess flow of make-up water prevents or inhibits the system water from becoming 'thick' Obviously, make-up water does not have to come from the dishmachine.

Although described in reference to specific configurations other modifications to the pulper are within the scope of the invention. If desired, a plurality of jet streams may be introduced into the inlet. The jet stream(s) may comprise a portion or all of the make-up water for the system either alone or in combination with the recycled liquor. Similarly, the by-pass stream for the drain chamber may use make up water with the recycled liquor.

Having described my invention, what I now claim is:

1. An apparatus for pulverizing waste materials to form an aqueous slurry which comprises:

a first housing having an inlet;

means to pulverize waste materials disposed in said first housing to form a slurry;

a second housing having:

an outlet for extracted pulp;

an inlet to receive the slurry from the first housing;

an auger having an upstream end and a downstream end, the upstream end in communication with the inlet, a sleeve-like screen disposed about the auger, the auger adapted to de-water the slurry to form a moist pulp and a liquor, the screen defining with the second housing a chamber to collect the liquor and an outlet to remove the liquor from the second housing;

a first conduit for the flow of the slurry from the first housing into the inlet of the second housing;

means to by-pass a portion of the liquor to introduce said by-passed portion as a jet stream directly into the upstream end of the auger to create turbulence and prevent accumulation of solids.

2. The apparatus of claim 1 wherein the means to by-pass is disposed to direct the jet stream in the direction of rotation of the auger.

3. The apparatus of claim 1 wherein the means to by-pass is adapted to direct the jet stream countercurrently to the direction of rotation of the auger.

4. The apparatus of claim 1 wherein the means to introduce said jet stream is a duct within said first conduit and the downstream end of the duct terminates in the inlet and a flow passage is defined between the end of the duct and the upstream end of the auger.

5. The apparatus of claim 1 which includes means to add make-up water to the system.

6. The apparatus of claim 1 wherein the first housing includes a drain and a screen is disposed about the drain to define a drain chamber; and which includes means to introduce a liquid stream into said drain chamber countercurrently to the direction of flow of the water discharged from the first housing into the drain chamber whereby turbulence is created at the interfacing between the screen and the slurry in the first housing.

7. The apparatus of claim 6 wherein the means to introduce the liquid stream into the drain chamber includes means to introduce the liquor into said chamber.

8. The apparatus of claim 6 which includes:

a second conduit to recycle the liquor from the outlet of the second housing to the first housing; and means secured to the second conduit and to the drain chamber to introduce the recycled liquor into said chamber.

9. The apparatus of claim 1 wherein includes:

a second conduit to recycle the liquor from the outlet of the second housing to the first housing.

10. The apparatus of claim 9 wherein the means to bypass includes:

a duct joined to the first and second conduits to intercept the recycled liquor flowing through the second conduit.

11. A method for pulverizing waste materials to form an aqueous slurry which includes:

pulverizing waste materials in a first housing to form a slurry;

introducing the slurry into a second housing where the slurry is progressively compressed by an auger from an upstream end to an end to de-water the slurry to form a liquor and a moist pulp;

bypassing a portion of the liquor and introducing said bypassed portion as a jet stream directly into the upstream end of the auger to create turbulence and prevent accumulation of solids at said end; and discharging the moist pulp.

12. The method of claim 11 which includes:

introducing the jet stream concurrently with the direction of rotation of the auger.

13. The method of claim 12 which includes:

introducing the jet stream countercurrently to the direction of rotation of the auger.

14. The method of claim 11 which includes:

flowing water from the first housing through a screen and into a drain chamber; and introducing a liquid stream into the drain chamber countercurrently to the direction of the flow of water flowing from the housing; and maintaining turbulence at the interface between the screen and the slurry.

15. The method of claim 14 which includes:

introducing a portion of the liquor into the drain chamber.

16. The method of claim 15 which includes:

flowing the liquor from the second housing to the first housing through a conduit and bypassing a portion of the liquor from the second conduit into the drain chamber.

* * * * *